United States Patent [19]

Williams

[11] 4,234,875

[45] Nov. 18, 1980

[54] SECURITY STRUCTURE

[75] Inventor: William H. Williams, Palos Verdes Peninsula, Calif.

[73] Assignee: Sandstone, Inc., La Mirada, Calif.

[21] Appl. No.: 883,487

[22] Filed: Mar. 6, 1978

[51] Int. Cl.[2] ..... G08B 13/12; E05G 1/10

[52] U.S. Cl. ..... 340/550; 340/541; 340/555; 340/652; 109/41; 109/42; 200/61.08

[58] Field of Search ..... 340/550, 540, 652, 541, 340/555; 109/21, 41, 42; 200/61.08; 174/117 F, 117 FF

[56] References Cited

U.S. PATENT DOCUMENTS

| | | | |
|---|---|---|---|
| 106,324 | 8/1870 | Chester | 109/42 |
| 237,603 | 2/1881 | Roome | 109/42 |
| 1,536,804 | 5/1925 | Mason | 109/42 |
| 2,101,040 | 12/1937 | Bayley et al. | 340/550 |
| 3,051,935 | 8/1962 | Willson | 340/550 |
| 3,594,770 | 7/1971 | Ham | 340/550 |
| 3,725,891 | 4/1973 | Miller | 340/550 |
| 3,863,242 | 1/1975 | Minton | 340/550 |

FOREIGN PATENT DOCUMENTS

| | | | |
|---|---|---|---|
| 2365679 | 9/1976 | France | 109/42 |

*Primary Examiner*—John W. Caldwell, Sr.
*Assistant Examiner*—Donnie L. Crosland
*Attorney, Agent, or Firm*—Wills, Green & Mueth

[57] ABSTRACT

A security panel arrangement for use with an intrusion alarm system designed to monitor the continuity of a normally continuous signal conductive path and to produce a warning signal when the signal conductive path is broken, which arrangement includes a cellular panel forming a series of parallel elongated passages through which extends at least one means for conducting a signal. The cellular panel is attached to a surface portion of a structure to be secured, and the means for conducting a signal is connected at its two ends to the alarm system in a continuity monitoring relationship therewith. Passage of a human being through the surface portion breaks the continuity of the means for conducting a signal and causes the alarm system to produce the warning signal.

35 Claims, 8 Drawing Figures

FIG.-1
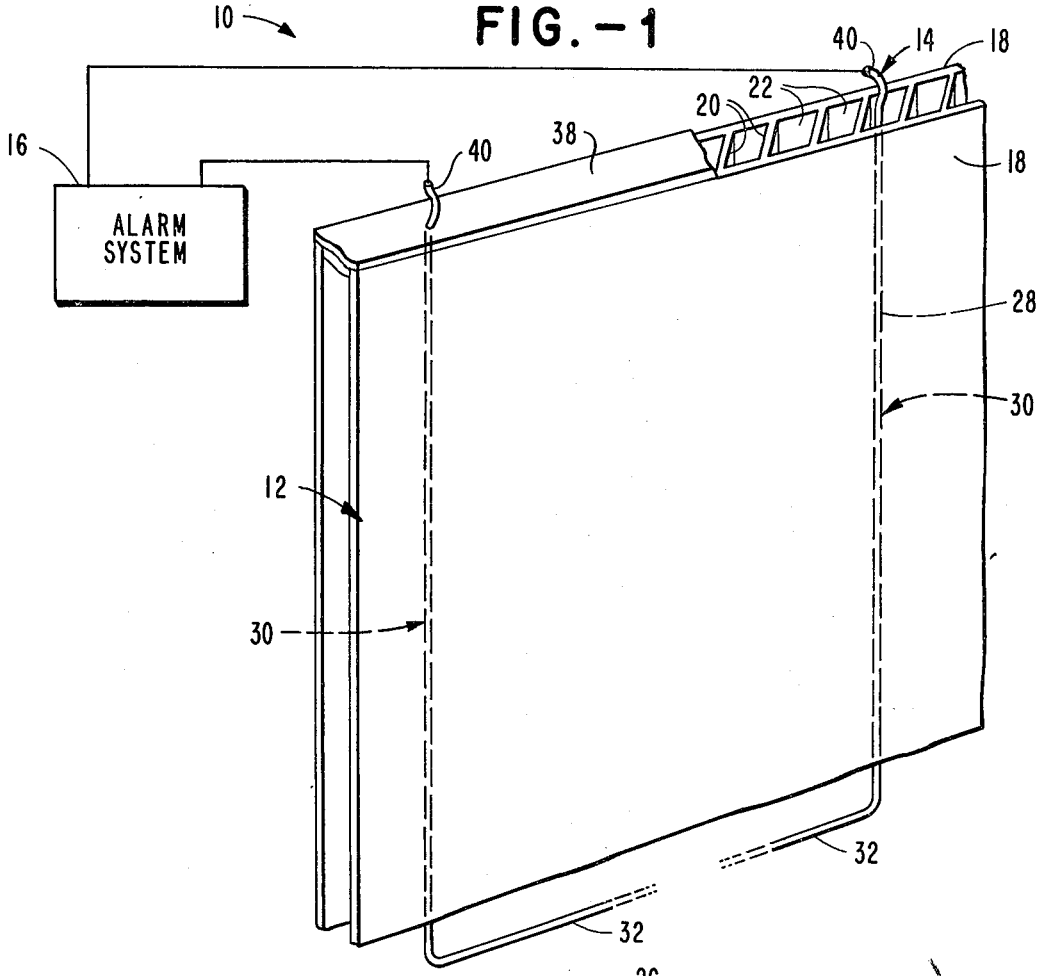
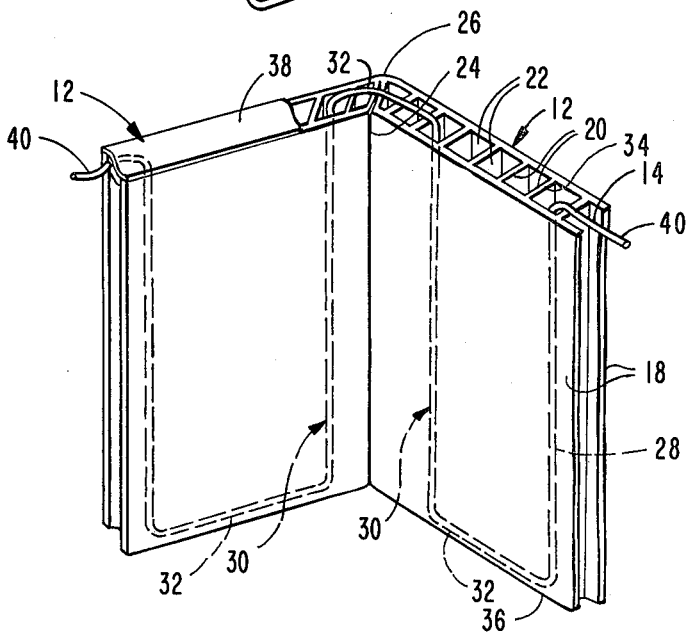
FIG.-2

FIG.-3
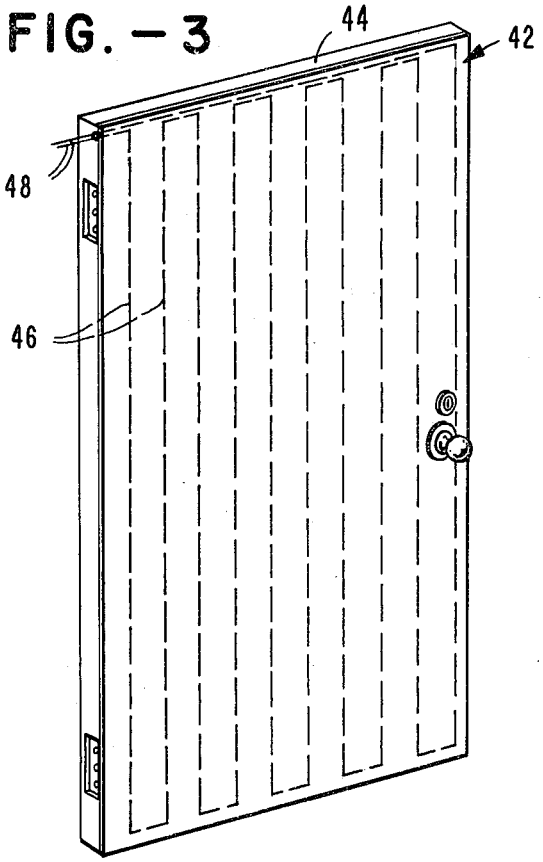
FIG.-4
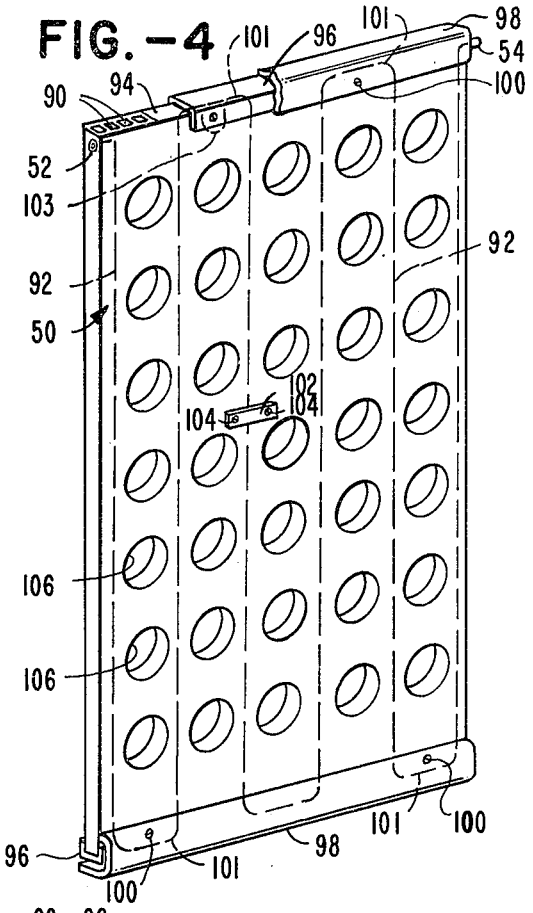
FIG.-6
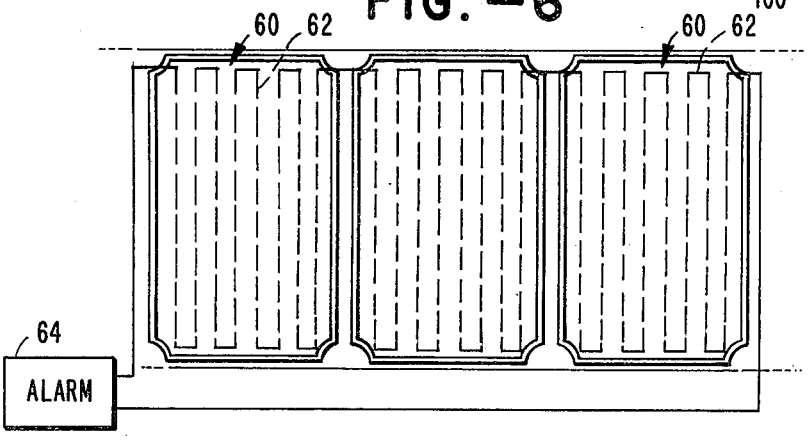
FIG.-5
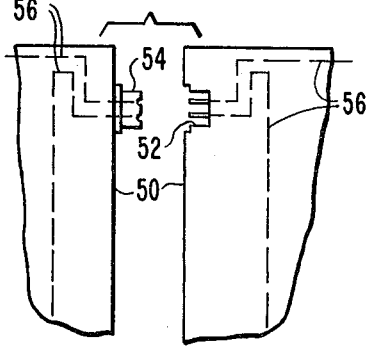
FIG.-7
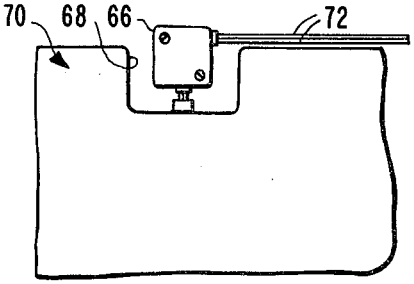
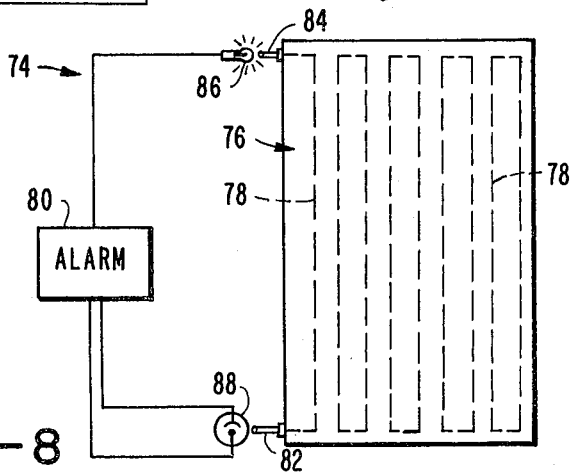
FIG.-8

SECURITY STRUCTURE

BACKGROUND OF THE INVENTION

1. Field of the Invention

This invention relates to the intrusion alarm art, and more particularly, to a security panel arrangement usable in intrusion alarm systems to secure surface portions of a structure from unauthorized breach.

2. Description of the Prior Art

Alarm systems for warning of unauthorized intrusion into a structure are most commonly designed to detect the unauthorized opening or removal of the doors or windows of the structure. However, in many situations entry may also be had by breaking into the structure without opening a door or window. Many walls, hollow core doors, wooden floors, skylights, and air ducts, for example, are easy prey for a thief or other unauthorized intruder. Alarm systems which monitor only the opening of doors and windows can thus be circumvented.

The only intrusion alarm systems known to me which are triggered by an intruder breaking through a wall or a door itself involve lacing the surface to be secured with a continuous wire or other conductor. The conductor is then connected to a mechanism designed to monitor its continuity and to produce a warning signal when the continuity is broken. The wires in these systems are fastened directly to the surface to be secured.

Such arrangements have many drawbacks when applied to surfaces such as walls and doors. Initially, they are quite expensive to install due to the high labor cost of manually applying the conductor to the surface in a desired pattern. The lacing operation should be performed by a qualified electrician capable of calculating the resistance of the overall system by taking into account the length of wire, the pattern in which it is applied and the number and type of joints used. The wire must also be skillfully applied to avoid an increase in electrical resistance which results from straining the wire. The resulting configuration is then completely exposed to damage from physical contact therewith and to possible circumvention thereof by an intruder having access to the interior of the structure prior to his planned intrusion. The exposed wires are also subject to deterioration from exposure to the elements and are unsightly in many contexts.

It is therefore desirable in many applications to provide a security device which may be applied to the walls and other surfaces of a structure to monitor unauthorized breach thereof and which may be inexpensively applied and be protected from physical damage and deterioration. The device should also be visually undetectable when installed, if desired.

SUMMARY OF THE INVENTION

Accordingly, it is an object of the present invention to provide a security structure for use in conjunction with an intrusion alarm system to monitor the unauthorized breach of a surface.

It is another object of the present invention to provide an improved security structure which may be inexpensively installed in modular form to secure a particular surface from unauthorized intrusion.

It is yet another object of the present invention to provide an improved security structure which may be economically fabricated and installed without lacing skills, will provide a long operational life, and will be relatively tamper-proof.

It is a further object of the present invention to provide an improved security structure which can be made virtually undetectable, if desired.

The above, and other objects of the present invention, are achieved, according to a preferred embodiment thereof, by providing a cellular panel having a series of elongated passages therethrough and at least one continuous means for conducting a signal extending through at least one of the elongated passages. The means for conducting a signal is connected at its ends to an alarm system designed to monitor the continuity of that means and to produce a warning signal when the means becomes discontinuous. The cellular panel is attached to and covers an area on a surface of a structure to be secured, and includes two coextensive parallel outer walls spaced a relatively small distance apart with a series of elongated, substantially parallel inner walls joining the outer walls. The series of elongated passages is thus formed between the outer walls and extends parallel thereto. Passage of a human being through the surface of the structure to be secured breaks the continuity of the signal conducting means and causes the alarm system to produce the warning signal.

The outer walls may be formed integrally with the inner walls and the cellular panels may include a plurality of modules connectible together to form a panel covering a desired area on the surface to be secured. The signal conducting means then includes at least one signal conductive section within each of the modules, with connectors at the ends thereof. The signal conductive sections are thus connectible to extend continuously through the cellular panel for the modules connected together. The cellular panels may also be foldable longitudinally of the elongated passages to allow the panel to fit against the contour of the surface at a corner thereof. The panel may be sealed along the edges thereof adjacent the ends of the elongated passages with a compound which covers those ends and encloses any lengths of the signal conducting means leading from one of the elongated passages to another. A trim strip may also be attached to cover the edges of the panel means to further finish them and provide a somewhat more durable seal.

The edge of the panel may be fixed to the surface by a moulding strip having attaching screws which pass through the panel at a point inboard of a section of the signal conducting means, such that an intruder who penetrates the surface and encounters the panel will tear the panel and the signal conducting means if he pushes the panel from the surface to enter the structure. The alarm will thus be set off whether access into the structure is had by cutting through the panel or pushing it from the wall. A similar result can be achieved by placing a small strap over the panel such that it lies across a length of the signal conducting means and is secured to the surface of the structure on either side thereof. An intruder pushing the panel from the surface therefore will cause the panel to break away adjacent the strap and will sever the signal conducting means. The attaching hardware in this case preferably penetrates the panel at the locations of elongated passages which do not contain said signal conducting means, thus avoiding unnecessary contamination or corrosion of the signal conducting means.

The signal conducting means may comprise at least one electrically conductive wire connected in series with an electrical sensing circuit of the alarm system. The wire may be either bare or insulated metallic wire, depending upon the application. The signal conducting means may further include a terminal means mounted to the surface of the structure to be secured at a point adjacent the cellular panel and connected in series with the conductive wire so that detachment and movement of the cellular panel from the surface will disconnect the conductive wire from the terminal means. This breaks the continuity of the conductive wire and causes the alarm system to produce the warning signal. The terminal means may be a printed circuit board adapted for the purpose and may be received within a cutout portion of the cellular panel for the cellular panel attached to the surface to be secured.

The signal conducting means may also include at least one optical fiber. The continuity of the optical fiber is then monitored by the alarm system by passing light therethrough and sensing whether the light is conducted along the entire length of the fiber.

The security structure of the instant invention may be mass produced in modular form and easily assembled at the job site to form a relatively thin, flat panel over the surface to be secured. All wires and connections are protected from damage or deterioration by their enclosure within the panel. The panels are adapted to cover virtually any surface, including walls, doors, windows, floors or air ducts. They may be painted, wallpapered, carpeted, or otherwise covered in the same manner as an unsecured surface to completely hide the arrangement from view. Further, the panel itself may be formed in a decorative shape to provide a desired relief effect against the background of the surface to be secured.

BRIEF DESCRIPTION OF THE DRAWINGS

The above and other objects of the present invention may be more fully understood from the following detailed description taken together with the accompanying drawings wherein similar reference characters refer to similar elements throughout and in which:

FIG. 1 is a fragmentary perspective view of one embodiment of a security panel arrangement constructed in accordance with the instant invention;

FIG. 2 is a fragmentary perspective view of the embodiment of FIG. 1 folded longitudinally of the elongated openings therethrough;

FIG. 3 is a perspective view of a door to which is applied a security panel arrangement constructed in accordance with the instant invention;

FIG. 4 is a perspective view of a security panel module constructed in accordance with the instant invention and including trim strips and mouldings at its upper and lower edges;

FIG. 5 is a fragmentary front elevational view of corresponding edges of two security panel modules similar to that illustrated in FIG. 1 having interfitting connectors;

FIG. 6 illustrates the decorative arrangement of security panels constructed in accordance with the instant invention to produce a relief effect against the wall of a building;

FIG. 7 is a fragmentary front elevational view of a portion of a security panel constructed in accordance with the instant invention which is connected to a terminal apparatus mounted directly to the wall surface; and FIG. 8 illustrates a security panel arrangement of the instant invention having an optical path therethrough.

DESCRIPTION OF THE PREFERRED EMBODIMENTS

Referring now to FIG. 1 there is illustrated one embodiment, generally designated 10, of the present invention. The embodiment 10 comprises a cellular panel 12 having an electrically conductive path 14 connected to an intrusion alarm system shown diagrammatically at 16.

The cellular panel 12 has a pair of outer vertical walls 18 which are parallel and co-extensive with each other and are spaced a relatively small distance apart. A series of substantially parallel inner walls 20 join the outer walls 18 to form a series of elongated passages 22 within the cellular panel 12. The inner walls 20 are preferably oriented vertically to cause the elongated passages 22 to be vertical as well. The cellular panel 12 may be constructed of a suitable plastic or other inexpensive material, and is preferably manufactured by an extrusion process. The outer and inner walls 18 and 20, respectively, are thus formed as an integral unit which may be easily and inexpensively mass produced. The cellular panel 12 may be made either of a rigid or a semi-rigid plastic or other material, depending upon the properties desired in the finished panel. Use of a semi-rigid plastic yields a cellular panel 12 which is bendable longitudinally of the elongated passages 22 to a desired angle, as shown at FIG. 2. The elongated passages closest to the point of bending are somewhat deformed in the bending process, but the cellular construction of the panel 12 causes the bent panel to form generally accurate inner and outer corners 24 and 26, respectively, enabling the panel 12 to be used satisfactorily to cover both inner and outer corners of a structure to be secured.

The panel 12 may be used to cover light transmitting surfaces such as windows and skylights as well as walls and doors. Where light transmission is desired, the panel 12 may be formed of a transparent plastic such as polymethacrylate. Otherwise, less expensive translucent or opaque plastics such as polypropylene or polycarbonate are preferred.

The electrically conductive path 14 includes a wire 28 strung through some of the elongated passages 22. The wire 28 comprises a series of parallel elongated sections 30 located within elongated passages 22 and connected by end sections 32 to form the continuous electrically conductive path 14. The wire 28 may be air-blown through the elongated passages 22 during manufacture of the embodiment 10. For this purpose, the end of the wire 28 may be attached to an object capable of being easily blown through one of the elongated passages 22. In the final configuration, the wire 28 has been drawn taut through the elongated passages 22 such that the end sections 32 thereof are held against the upper and lower edges 34 and 36, respectively, of the cellular panel 12 adjacent the open ends of the passages 22. The edges 34 and 36 may be sealed, as by a silicone or other sealer compound 38, to enclose the wire 28 and prevent inadvertent damage or deterioration thereof during the life of the cellular panel 12. The wire 28 may be either bare or insulated wire, depending upon the requirements of the alarm system used. For example, small gauge hard drawn copper wire may be used in many low voltage systems, due to the dielectric properties of the cellular panel 12, while other systems require a heaver gauge, insulated wire. The use of stranded wire may also be preferred in some cases.

The intrusion alarm system 16 may include a conventional alarm designed to monitor the continuity of a normally closed conductive path and to produce a warning signal when that path is broken. Such alarms often have a circuit for passing a constant low current through the conductive path to monitor its continuity. The alarm automatically goes off when that current ceases. The ends 40 of the electrically conducted path 14 of the embodiment 10 are connected to the sensing circuit of the alarm 16 which passes a constant low current therethrough. A person breaking or cutting through the cellular panel 12 and the wire 28 will cause a discontinuity in the electrically conductive path 14 and cessation of the current therethrough. The warning signal is then produced by the alarm system 16.

The wire 28 is loomed through the elongated passages 22 of the cellular panel 12 at intervals sufficiently close to prevent passage of a human being through the cellular panel 12 without interruption of the wire 28. An interval of approximately 4 inches between elongated sections 30 of the wire 28 is optimal for this purpose.

Referring now to FIG. 3, a panel 42 which is similar to the cellular panel 12 is fitted to a door 44. An electrically conductive path 46 is shown diagramatically within the panel 42 and terminates in lead wires 48. The electrically conductive path 46 is continuous between its ends and is similar in configuration to the electrically conductive path 14 of FIGS. 1 and 2. The panel 42 may be glued, nailed, or otherwise retained to the surface of the door 44. The leads 48 incorporate enough slack to allow opening and closing of the door 44 after the device is installed. The leads 48 are connected to an alarm similar to the alarm 16 described above. Anyone breaking or cutting through the door 44 to create a passage large enough for a human being to pass therethrough will interrupt the electrically conductive path 46 and set off the alarm.

Referring now to FIG. 4, there is illustrated the device of the present invention in modular form. A single module 50 is rectangular in shape and may be 8 feet tall to cover a conventional wall from floor to ceiling. It is of the same basic construction as the embodiment 10, and therefore has an array of elongated passages 90 through which extends a conductive wire 92. The ends of the passages 90 are sealed with a compound 94, as described in reference to the embodiment 10, and are then capped with trim strips 96. The trim strips 96 are elongated and have essentially "U"-shaped cross-sections adapted to receive the edges of the module 50, covering the compound 94 and aiding it in sealing the ends of the passages 90. The trim strips 96 may be made of any suitable material, such as a pliable plastic or rubber. The module 50 is provided with connectors 52 and 54 at the upper portions of its side surfaces to electrically connect the conductive paths of side-by-side modules to form the single electrically conductive path 14 of the present invention. The connectors 52 and 54 of corresponding modules 50 are shown in more detail in FIG. 5. The female connector 54 is adapted to receive the male connector 52 to create a positive connection between the conductive wires 56 of the two modules. The male connector 52 is shown recessed within the module 50 to protect its contacts, while the female connector 54 is made to extend outward from its module 50 into a position of engagement therewith. The connector at one end of a series of connected modules 50 is connected to the two leads of the alarm system 16, and the connector at the opposite end of the series of modules is shorted to produce a continuous electrically conductive path 14. The conductive wires 92 of adjoining modules 50 may, of course, be soldered together in lieu of the connectors 52 and 54. The modules 50 may be nailed, glued, or otherwise affixed to a surface of a structure.

A series of moulding strips 98 fit over the edges of the module 50 and are provided with retaining screws 100 which pass through the module 50 at a location near its edge and inboard of legs 101 of the wire 92. The screws 100 are anchored to the surface of the structure and hold the moulding strips 98 in position to prevent movement of the edges of the module 50 away from the surface. The moulding strips 98 and screws 100 are designed to hold against a force sufficient to remove the module 50 from the surface and to tear it and at least one of the legs 101 of the wire 92 from one of the moulding strips 98 by pushing away from the surface through an opening therein. If the module 50 is constructed of a flexible or semi-rigid material, for example, a sufficient outward force pushing away from the surface causes the module 50 to deform and draws the edges thereof along the surface and away from the moulding strips 98. This results in the module 50 being torn on the screws 100 from the points where the screws pass through the module to the edge thereof. The wire 92 will likewise be broken at one or more of the legs 101 to break the continuous circuit of the alarm system and cause the alarm to produce the warning signal. On the other hand, a module 50 constructed of a rigid material will tear or break entirely away from its edge portion under a sufficient force. This severs at least one of the wire legs 101 on the screws 100 to set off the alarm.

In operation, the moulding strips 98 provide protection against an intruder pushing the module 50 away from the surface of the structure without cutting through the module itself. Any such pushing action will break the normally closed alarm circuit by tearing the module 50 from the location of the screws 100 to its edge and severing the wire 92 adjacent thereto. The alarm will thus be set off whether the module is cut or merely pushed away from the surface.

The same result is accomplished using a strap 102 positioned across a portion of the wire 92 and secured in that position by a pair of retaining screws 92 which pass through the strap 102 and the module 50 and are anchored within the surface of the structure to be secured. An intruder pushing the module 50 from the wall will therefore tear a section out of the module 50 and sever the wire 92.

The module 50 may be partially cut away or otherwise weakened adjacent to the moulding strips 98 or the strap 102 to make the tearing operation easier and thus to more readily set off the alarm. For example, a slot 103 may be cut in from the edge of the module 50 toward the screws 100 for this purpose.

A series of air flow openings 106 may be provided in part of all of the module 50 between the passages 90 which contain the conductive wire 92. Air flow through the module 50 may therefore be had without exposing the wire 92 to the elements, enabling the module to secure the opening of an air duct without interfering with the operation of the duct. A module 50 may also only partially cover a duct opening or may be spaced outward therefrom to provide an adequate air flow passage without allowing a person to pass unless the wire 92 is severed.

It is to be understood that the structure described herein relative to the moulding strips 98, the strap 102, and the openings 106 are applicable as well to the embodiment 10 and the door panel 42.

FIG. 6 illustrates an arrangement of panels 60 which incorporates a cellular structure and a conductive path similar to those of the embodiments described above, but which are decoratively shaped and applied to the surface to be secured to enhance the appearance of the arrangement after installation as it provides positive intrusion protection. A continuous electrically conductive path 62 passes through the assembled panels 60 and is connected to an alarm 64 which may be identical to the alarm system 16 described above. A person breaking through the panel 60 will cut the continuous path 62 and cause the alarm 64 to go off.

FIG. 7 illustrates a terminal apparatus which may be incorporated in any of the embodiments discussed above, and which comprises generally a terminal board 66 fixed directly to the surface to be secured and received within a cutout portion 68 of a panel 70 for the installed condition of that panel. The panel 70 has a structure similar to that of the embodiment 10. The electrically conductive path within the panel 70 is connected to lead wires 72 of an alarm system through the terminal board 66. The mounting of the terminal board 66 to the surface to be secured is firm enough to anchor the terminal board 66 thereto in case the panel 70 is forced away from that surface by an intruder. The connection between the electrically conductive path within the panel 70 and the terminal board 66 is broken by such an intruder and the warning signal is produced. The terminal board 66 in this way prevents circumvention of the device of the present invention by merely pushing the cellular panel away from the surface to be secured in the same way as the moulding strips 98 and the strap 102 described above. The terminal board 66 may be a printed circuit board designed for the purpose.

Referring now to FIG. 8, there is illustrated a further embodiment, generally designated 74, of the present invention. The embodiment 74 includes a cellular panel 76, an optically conductive path 78, and an alarm system 80. The cellular panel 76 itself is identical to the cellular panel 12 of FIGS. 1 and 2 above. The optically conductive path 78 includes at least one continuous optical fiber loomed through the cellular panel 76 and operatively connected to the alarm system 80. The optically conductive path 78 terminates at two ends 82 and 84 at a point outside the cellular panel 76. A light source 86 of the alarm system 80 is positioned adjacent the end 84 to pass light along the optically conductive path 78 toward the end 82. A light sensor 88 of the alarm system 80 is positioned adjacent and opposite the end 82 to detect light reaching that end from the light source 86. The alarm system 80 is designed to produce a warning signal whenever the source of light to the sensor 88 is cut off, signifying that the optically conductive path 78 is broken. This happens whenever an intruder breaks through the cellular panel 76.

It is to be understood that each of the special features described above in relation to cellular panels having electrically conductive paths is also applicable to panel 76 having instead an optically conductive path. Among these features are the constructions of the cellular panel 12, the module 50, the moulding strips 98 and the straps 102. The flexibility of optical fibers also enables them to be applied to swinging doors as described in FIG. 3.

The smooth and flat outer surfaces of each of the panels described above enables those panels to be painted, wallpapered, or otherwise decorated exactly as a conventional wall or door may be decorated to provide a finished security panel arrangement having the appearance of a conventional wall.

The reliability of each of the above security panel arrangements in conjunction with an alarm system may be enhanced by the inclusion of more than one complete conductive path within each of the panels. Those paths may be loomed through the panels together in a side-by-side relationship or through different ones of the elongated passages in a random pattern. If the paths comprise electrical wires, it is preferred that the wires be insulated to avoid a short circuit therebetween. The wires may then be connected either to positive and negative sides of the alarm circuit, respectively, or to a pair of independent alarm circuits. The added reliability of such multiple conductor systems can quality the owner of a building for a somewhat lower theft insurance rate.

This concludes the description of the preferred embodiments of the present invention. From the above, it can be seen that there has been provided an improved security panel arrangement which may be easily and economically mass produced in modular form and adapted to a variety of surfaces to be secured for the purpose of triggering an alarm system when an intruder breaks through a particular panel.

The appended claims are intended to cover all variations and adaptations falling within the true scope and spirit of the present invention.

I claim:

1. A securing panel arrangement for use with an intrusion alarm system designed to monitor the continuity of a normally continuous signal conductive path and to produce a warning signal when the signal conductive path is broken, said arrangement comprising:

a cellular panel means positionable to cover an area on a surface of a structure to be secured and attachable thereto, including:

two generally co-extensive and substantially continuous parallel outer walls spaced a relatively small distance apart, and a series of elongated inner walls substantially parallel to each other joining said outer walls to form a series of parallel elongated passages therewith, said elongated passages extending parallel to said outer walls in the space therebetween;

at least one means for conducting a signal, continuous between two ends thereof and extending through at least one of said elongated passages in a configuration preventing passage of a human being through said panel means unless said at least one conducting means is severed; and means for connecting said at least one conducting means at said two ends thereof to the alarm system in a continuity monitoring relationship therewith;

whereby passage of a human being through the area on the surface and through said panel means breaks the continuity of said at least one conducting means and causes the alarm system to produce the warning signal.

2. The arrangement defined in claim 1 wherein said outer walls are integral with said inner walls.

3. The arrangement defined in claim 1 wherein said panel means comprises a plurality of prefabricated modules connectible together to form a panel means covering a desired area on the surface of the structure and said at least one conducting means comprises at least one conductive section within each of said modules and a plurality of male and female connectors at the respective ends of said conductive sections for the operative connection thereof.

4. The arrangement of claim 1 wherein said panel means is foldable longitudinally of said elongated passages, whereby said panel means may be adapted to follow the contour of the surface at a corner thereof.

5. The arrangement of claim 1 which includes a sealing compound covering the edges of said panel means adjacent the ends of said elongated passages, closing said elongated passages and enclosing any lengths of said at least one conducting means leading from one of said elongated passages to another.

6. The arrangement of claim 5 which includes a trim strip attachable to cover the edges of said panel means adjacent the ends of said elongated passages and said sealing compound thereon.

7. The arrangement defined in claim 1 wherein said configuration of said at least one conducting means comprises a series of parallel lengths thereof extending through various ones of said elongated passages which are substantially equally spaced along said panel means.

8. The arrangement defined in claim 1 wherein said panel means is rigid.

9. The arrangement defined in claim 1 wherein said panel means is pliable.

10. The arrangement defined in claim 1 wherein said panel means is made of plastic.

11. The arrangement of claim 1 which further comprises:

an elongated strap; and means for attaching said strap at two ends thereof to the surface with a section of said panel means containing a portion of said at least one conducting means confined between said strap and said surface such that an intruder pushing said panel means away from said surface after penetrating said surface will sever said panel means and said at least one conducting means from said section of said panel means and the portion of said at least one conducting means confined by said strap means, breaking the continuity of said at least one conducting means and causing the alarm to product the warning signal.

12. The arrangement of claim 11 wherein said strap is positioned across one of said elongated passages which contains said portion of said at least one conducting means with said attaching means aligned to pass through two of said elongated passages which do not contain said at least one conducting means.

13. The arrangement of claim 1 wherein:

said at least one conducting means includes a leg running through a peripheral portion of said panel means; and said arrangement further comprises:

at least one panel holding element positionable over said peripheral portion of said panel means for said panel means covering the area on the surface to be secured; and means for attaching said holding element to the surface through said peripheral portion of said panel means at a location on said panel means somewhat inboard of said leg of said at least one conducting means, confining said peripheral portion of said panel means and said leg between said holding element and said surface;

such that pushing said panel means away from said surface after penetrating the surface will sever said panel means and said leg, breaking the continuity of said at least one conducting means and causing the alarm to produce the warning signal.

14. The arrangement of claim 13 wherein said at least one panel holding element comprises at least one moulding strip and said attaching means comprises at least one screw thread mechanism.

15. The arrangement of claim 14 wherein the peripheral portion of said panel means is weakened adjacent to the attaching means to facilitate tearing said panel means and said leg of said conducting means from said holding element.

16. The arrangement defined in claim 1 wherein said at least one conducting means comprises at least one electrically conductive wire means and said connecting means comprises means for connecting said wire means at said two ends thereof in series with an electrical circuit of the alarm system.

17. The arrangement defined in claim 16 wherein said at least one wire means comprises bare metallic wire.

18. The arrangement defined in claim 16 wherein said at least one wire means comprises insulated metallic wire.

19. The arrangement defined in claim 16 wherein said at least one conducting means comprises terminal means mounted to the surface of the structure at a point adjacent said panel means and connected in series with said at least one wire means so that detachment and movement of said panel means from said surface for said terminal means mounted to said surface disconnects said wire means from said terminal means, thereby breaking the continuity of said at least one conducting means.

20. The arrangement defined in claim 19 wherein said terminal means comprises a printed circuit board.

21. The arrangement defined in claim 20 wherein said panel means is cut out to receive said printed circuit board for said panel means attached to the surface.

22. The arrangement defined in claim 20 wherein said outer walls are integral with said inner walls.

23. The arrangement defined in claim 22 wherein said panel means comprises a plurality of modules connectible together to form a panel means covering a desired area on the surface of the structure and said at least one wire means comprises at least one wire section within each of said modules and a plurality of male and female connectors at the respective ends of said wire sections for the operative connection thereof.

24. The arrangement of claim 23 wherein said panel means is foldable longitudinally of said elongated passages, whereby said panel means may be adapted to follow the contour of the surface at a corner thereof.

25. The arrangement of claim 24 which includes a sealing compound covering the edges of said panel means adjacent the ends of said elongated passages, closing said elongated passages and enclosing any lengths of said at least one wire means leading from one of said elongated passages to another.

26. The arrangement of claim 25 which includes a trim strip attachable to cover the edges of said panel means adjacent the ends of said elongated passages and said sealing compound thereon.

27. The arrangement defined in claim 26 wherein said configuration of said at least one wire means comprises a series of parallel lengths of wire extending through various ones of said elongated passages which are substantially equally spaced along said panel means.

28. The arrangement defined in claim 1 wherein said at least one conducting means comprises at least one optical fiber means.

29. The arrangement defined in claim 28 wherein said outer walls are integral with said inner walls.

30. The arrangement defined in claim 29 wherein said panel means comprises a plurality of modules connectible together to form a panel means covering a desired area on the surface of the structure and said at least one optical fiber means comprises at least one optical fiber section within each of said modules and a plurality of male and female connectors at the respective ends of said optical fiber sections for the operative connection thereof.

31. The arrangement of claim 30 wherein said panel means is foldable longitudinally of said elongated passages, whereby said panel means may be adapted to follow the contour of the surface at a corner thereof.

32. The arrangement of claim 31 which includes a trim strip attachable to cover the edges of said panel means adjacent the ends of said elongated passages, covering said ends and enclosing any lengths of said at least one optical fiber means leading from one of said elongated passages to another.

33. The arrangement of claim 32 which includes a silicone sealer compound covering the edges of said panel means adjacent the ends of said elongated passages, covering said ends and enclosing any lengths of said at least one optical fiber means leading from one of said elongated passages to another.

34. The arrangement defined in claim 33 wherein said configuration of said at least one conducting means comprises a series of parallel optical fibers lengths extending through various ones of said elongated passages which are substantially equally spaced along said panel means.

35. The arrangement of claim 1 wherein said panel means defines at least one opening passing from one of said outer walls to the other whereby air can flow through said panel means in a direction substantially normal thereto.

* * * * *